US008181760B2

(12) United States Patent
Trieu

(10) Patent No.: US 8,181,760 B2
(45) Date of Patent: May 22, 2012

(54) EQUIPMENT CONTAINER WITH INTEGRATED STAND

(75) Inventor: Nam Tim Trieu, Monterey Park, CA (US)

(73) Assignee: Nam Tim Trieu, Monterey Park, CA (US)

( * ) Notice: Subject to any disclaimer, the term of this patent is extended or adjusted under 35 U.S.C. 154(b) by 437 days.

(21) Appl. No.: 12/607,835

(22) Filed: Oct. 28, 2009

(65) Prior Publication Data

US 2011/0094908 A1 Apr. 28, 2011

(51) Int. Cl.
*B65D 85/38* (2006.01)

(52) U.S. Cl. ..... 190/1; 190/18 R; 206/316.2; 206/305; 352/242; 396/419; 396/428

(58) Field of Classification Search ..... 190/18 R, 190/1; 206/578, 305, 316.2; 352/242; 396/419, 396/428

See application file for complete search history.

(56) References Cited

U.S. PATENT DOCUMENTS

| | | | | |
|---|---|---|---|---|
| 3,826,513 | A | 7/1974 | Wolf | |
| 3,863,945 | A | 2/1975 | Dunstan | |
| 5,598,963 | A * | 2/1997 | Buswell | 224/664 |
| D598,671 | S * | 8/2009 | Gagnon, Jr. | D6/430 |
| 7,856,627 | B2 * | 12/2010 | Archambault et al. | 717/151 |
| 7,870,937 | B1 * | 1/2011 | Arnao | 190/1 |
| 2004/0226791 | A1 * | 11/2004 | Levy | 190/11 |
| 2007/0206115 | A1 * | 9/2007 | Kuo | 348/373 |

* cited by examiner

*Primary Examiner* — Tri Mai

(57) ABSTRACT

Herein is described an equipment container with an integrated stand comprising a bag with a lid and a base, retractable legs, and a movable post attached to the lid, wherein the retractable legs can be enclosed into the base of the bag, and the movable post is adapted to be stowed for transport or deployed to support a piece of equipment.

6 Claims, 2 Drawing Sheets

EQUIPMENT CONTAINER WITH INTEGRATED STAND

BACKGROUND OF THE INVENTION

The present invention generally relates to equipment bags and to stands to support the equipment. People have trouble carrying both a bag containing, for example a camera, and a tripod needed to support the camera when in use.

As can be seen, there is a need for a system to carry the equipment and its support stand efficiently.

SUMMARY OF THE INVENTION

One aspect of the present invention is an equipment container with an integrated stand comprising a bag comprising an open end and a closed end sealed by a base, the open end having an attached lid, a compartment having a peripheral side wall attached to and extending away from the base of the container, retractable legs attached to the base of the bag and extending away from the bag where the retractable legs can be enclosed into the compartment in the base of the bag, and a movable post attached to a surface of the lid, the movable post disposed to be deployed from a substantially horizontal position to a substantially vertical position to support a piece of equipment.

Another aspect of the present invention is a camera container with an integrated quadpod stand comprising a bag comprising an open end and a closed end sealed by a base, the open end having an attached lid, a compartment having a peripheral side wall attached to and extending away from the base of the container, four folding legs, and a movable post attached to a surface of the lid, the movable post disposed to be deployed from a substantially horizontal position to a substantially vertical position to support the camera, wherein the four folding legs can be extended to form a quadpod stand or folded and enclosed into the compartment of the bag, the movable post adapted to be deployed up to support a camera or down to be stowed for transport.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide equipment bags and to stands to support the equipment.

An embodiment of the invention (10) combines both a stand, such as a quadpod (four-leg stand) and camera bag as one item. Instead of carrying two separate things, a user has an integrated camera bag and quadpod. The camera bag converts to a stand (see FIG. 1 for the unit (10) in use as an equipment stand).

Figure 1:
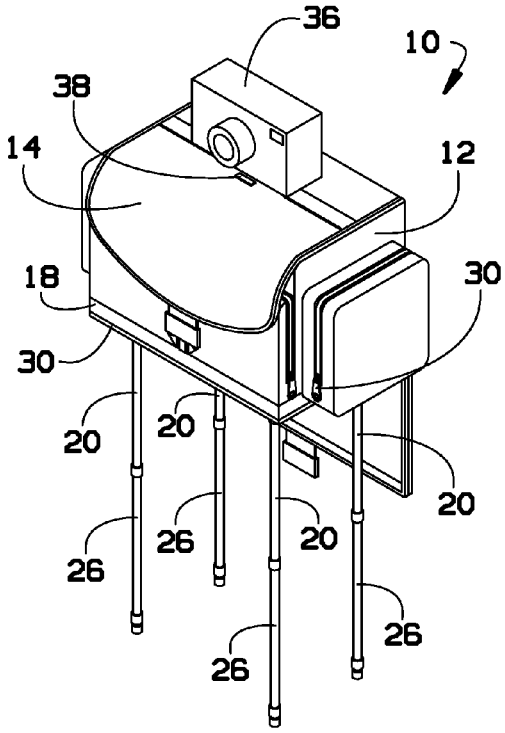
FIG. 1 shows a perspective view of an exemplary embodiment of the invention in use.
Figure 3:
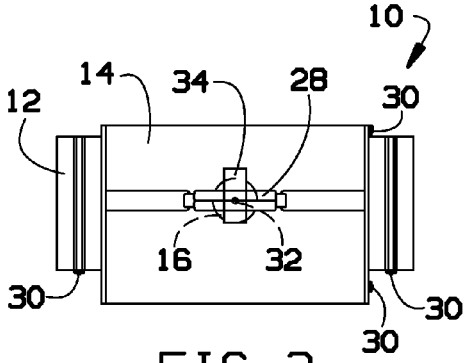
FIG. 3 shows a top view of an exemplary embodiment of the invention with the camera (36) omitted for clarity.

With reference to FIG. 1, an equipment bag (12) is shown that can have several compartments on the inside or outside of the bag (12) for storing auxiliary equipment such as batteries, recording media, cords, and the like, and can have a handle (28) for ease of carrying. A metal attachment rod (16) is integrated into the lid (14) of the bag (12) and be secured through a hole (32) in the lid (14) (FIG. 3) to be used to mount the camera (36) to the quadpod stand (see FIGS. 1, 4, 5) and can slide, fold, or screw down and the hole (32) be covered by a flap (34) to be stowed for carrying the unit (10). The flap (34) can be secured with, for example, a hook and loop fastener. In an alternative embodiment, the rod (16) can be detached from the lid (14) and stowed.

Figure 2:
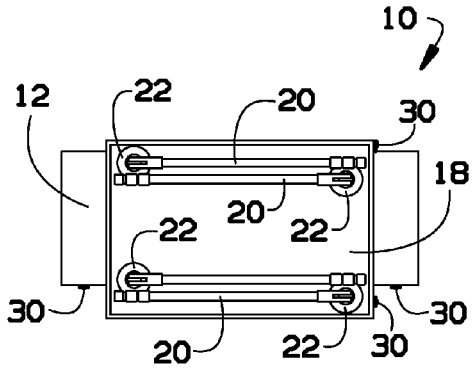
FIG. 2 shows a bottom view of an exemplary embodiment of the invention showing the base and the retractable legs in the folded position and the bottom open to show detail.
Figure 4:
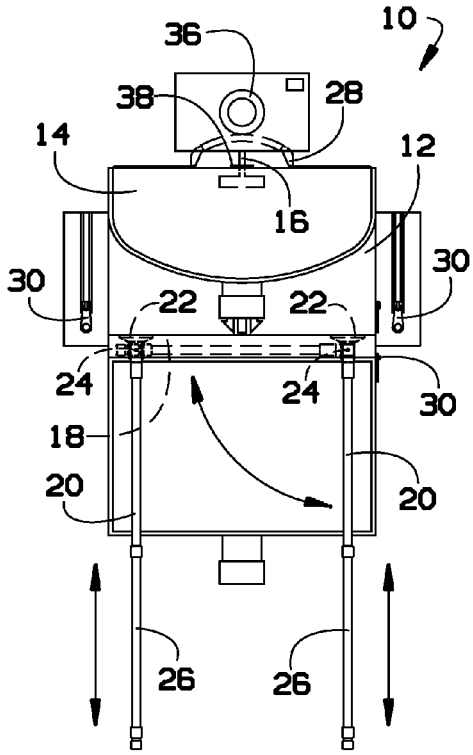
FIG. 4 shows a front view of an exemplary embodiment of the invention illustrating the foldable and retractable legs.
Figure 5:
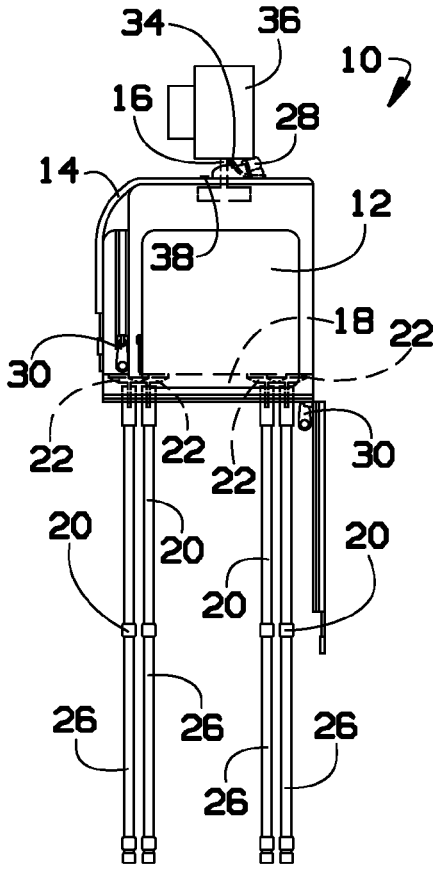
FIG. 5 shows a side view of an exemplary embodiment of the invention.
Figure 6:
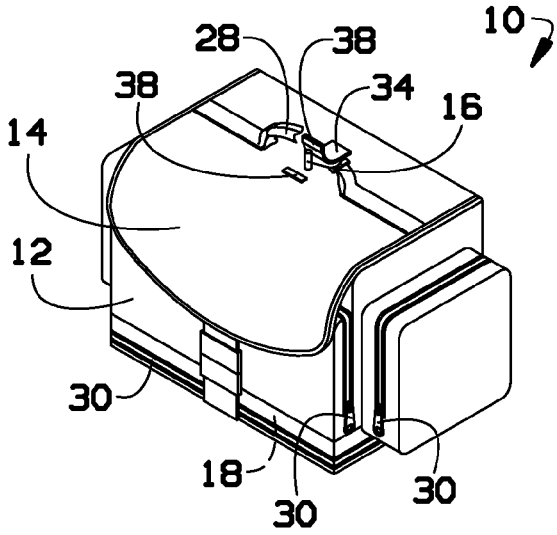
FIG. 6 shows a perspective view of an exemplary embodiment of the invention illustrating the closed bag (12) and attachment rod (16) in use (camera (36) omitted and handle (28) shown broken for clarity).

The quadpod stand is designed with four retractable legs (20) that can be stowed while the unit is being carried (FIG. 2), and extended to form a quadpod stand to support the camera when in use (FIGS. 1, 4, 5). When retracted, the legs (20) are stored in a compartment (18) in the bottom of the bag (12). The compartment (18) can be left open, or can be sealed, for example with a flap having a zipper (30), to keep the legs (20) secure while the unit (10) is carried.

The quadpod legs (20) are retractable and can be adjusted to different heights. The legs (20) can be made retractable by, for example, being hinged (24) such that they can be folded up under the bag (12), or being made with a telescoping design (see FIG. 4) such that the telescoping portion (26) of the leg (20) can extend out or be retracted. The telescopic legs (20) can also be made such that the legs (20) are hinged (24) so that the unextended legs (20) can be folded up under the bag (12) and secured in a separate compartment (18) in the bottom of the bag (12). The telescopic legs (12) can be made with a ruler on the extendable portion (26) as an aid in adjusting legs (20) to a preferred height and an aid to extending legs (20) to the same length to provide a level platform for the bag (12). Typically the legs (20) can be extended from about one inch to about four feet. Legs (12) can be made from metal, plastic, wood, or any other rigid material appropriately stiff and strong enough to support the equipment and bag (12).

The bag can also be used as a camcorder bag, binoculars bag, telescope bag, laptop computer bag, or a bag for any sort of equipment that is carried and benefits from having a stand. The bag can be made, for example, with a hard plastic interior covered with an exterior layer made of vinyl, fabric, leather, or the like.

Other configurations of bags and legs are contemplated, for example a bag with a triangular base and three legs or a bag with a hexagonal base and six legs.

In an alternative embodiment, the camera bag can be used as a picnic basket. The picnic basket can act as table stand. It should be understood, of course, that the foregoing relates to exemplary embodiments of the invention and that modifications may be made without departing from the spirit and scope of the invention as set forth in the following claims.

I claim:

1. An equipment container with an integrated stand comprising:

a bag comprising an open end and a closed end sealed by a base, the open end having an attached lid a front side and a back side, said lid hingedly attached to said back side and size for disposing across the open end and overlap and secure to the front wall;

a compartment having a peripheral side wall attached to and extending away from the base of the container;

retractable legs attached to the base of the bag and extending away from the bag where the retractable legs can be enclosed into the compartment; and a movable post attached to a surface of the lid, the movable post disposed through a hole in the lid to support a piece of equipment.

2. The equipment container with an integrated stand of claim 1 where the retractable legs are hinged.

3. The equipment container with an integrated stand of claim 1 where the retractable legs are telescoping.

4. The equipment container with an integrated stand of claim 1 where there are four retractable legs.

5. The equipment container with an integrated stand of claim 1 where the container has additional compartments adapted for storing auxiliary pieces.

6. A camera container with an integrated quadpod stand comprising:

a bag comprising an open end and a closed end sealed by a base, the open end having an attached lid a front side and a back side, said lid hingedly attached to said back side and size for disposing across the open end and overlap and secure to the front wall;

a compartment having a peripheral side wall attached to and extending away from the base of the container;

four folding legs; and a movable post attached to a surface of the lid, the movable post disposed through a hole in the lid to support a camera;

wherein the four folding legs can be extended to form a quadpod stand or folded and enclosed into the compartment of the bag, the movable post adapted to be deployed up to support a camera or down to be stowed for transport.

* * * * *